United States Patent [19]

Redrow

[11] Patent Number: 5,035,429

[45] Date of Patent: Jul. 30, 1991

[54] STRING STRAIGHTENER FOR TENNIS RACKET

[76] Inventor: Allan Redrow, Apt. #6, 12 Brookside Ave., Worcester, Mass. 01602

[21] Appl. No.: 550,019

[22] Filed: Jul. 9, 1990

[51] Int. Cl.[5] ..... A63B 51/00

[52] U.S. Cl. ..... 273/73 R; 273/73 A

[58] Field of Search ..... 273/73 R, 73 A, 73 B, 273/73 D, 74, 29 R

[56] References Cited

U.S. PATENT DOCUMENTS 4,733,866 3/1988 Herbert ..... 273/73 R 4,776,591 10/1988 Ho ..... 273/73 R

*Primary Examiner*—Edward M. Coven

*Assistant Examiner*—Raleigh W. Chiu

*Attorney, Agent, or Firm*—Shlesinger Arkwright Garvey

[57] ABSTRACT

A device is shown that is adapted to be placed on the strings in the head of a tennis racket adjacent a bowed or displaced string in the woven pattern of strings, which device can be manually manipulated to move the string back to its a correct position in the woven pattern. The string straightener is constructed to automatically adjust itself to be fitted to any conventional woven string pattern in the usual form of tennis rackets.

12 Claims, 1 Drawing Sheet

STRING STRAIGHTENER FOR TENNIS RACKET

This invention relates to tennis rackets and particularly to a device for straightening the strings in a tennis racket after it has been used.

RELATED APPLICATION

This invention is an improvement based on my earlier filed application Ser. No. 07/298,018 filed Jan. 10, 1989, now abandoned.

BACKGROUND

A tennis racket principally consists of a head or frame element for supporting a set of strings that are interlaced in a spaced apart woven pattern, a throat and a handle element. When the racket is initially strung the tension of the strings is carefully controlled in accordance with the preference of the player for whom the racket is being strung. Normally the main and cross strings are stretched to a tension of a 60 or 70 pounds pull but some players prefer a lighter tension as low as even a 40 pounds pull. No matter how low or how high the tension is controlled in the stringing process, during play it has frequently been observed that the crossing pattern of the woven strings is disturbed. When this happens, a particular string or more usually several strings near the center of the frame area, principally the crossing strings are bowed away from their usual 90° crossing pattern.

When a string is stretched to a bowed position away from its original position it is elongated and obviously the original tension of the string system in the racket has been changed. This modifies the hitting properties of the racket and consciously or unconsciously affects the player's control of the ball as it leaves the surface of the racket and has a bearing on the direction and velocity of the ball in its path of travel.

Therefore, it is desirable to control the position of the individual strings in the woven pattern as closely as possible to their original positions at all times in order to maintain the designed tension in the hitting area in the bow or frame of the racket. Heretofore it has been the practice of tennis players to use the tips of their fingers to pull the strings back to their approximately correct positions from time to time when they have completed their active playing session.

| Prior Art | |
|---|---|
| U.S. Pat. Nos.; | |
| 1,514,273 to Van Schenk | Nov. 4, 1924 |
| 2,156,092 to Johnson | Apr. 25, 1939 |
| 4,082,272 to Garver | Apr. 4, 1978 |
| 4,089,523 to Newburger et al | May 16, 1978 |
| 4,359,213 to Bachman et al | Nov. 16, 1982 |
| 4,489,942 to Kent | Dec. 25, 1984 |
| 4,733,866 to Herbert | Mar. 29, 1988 |
| 4,776,591 to Ho | Oct. 11, 1989 |
| 3,135,521 to Langenbach (W. Germany) | Mar. 24, 1883 |

The above listed patents were made of record in my prior application to show various devices that have a bearing on the art of manipulating the strings in the head element of a tennis racket to maintain the strings in their designed positions during the stringing operation or to return them to a proper position in their respective woven patterns.

The U.S. Pat. Nos. 2,156,092 to Johnson, Apr. 25, 1939; 4,082,272 to Garver Apr. 4, 1978 and 4,359,213 to Bachman Nov. 16, 1982 all show devices that are useful during the initial stringing operation for mounting the woven pattern of strings in the head or frame of the racket. These disclosures all relate to the original setting of the strings and are not concerned with nor are they useful for resetting the strings after play with the racket has been completed, and during which play action the reaction of the ball against the strings may have caused some unwanted displacement of the strings from their normal pattern.

The U.S. Pat. Nos. 4,089,523 to Newburger et al; 4,489,942 to Kent; and the German patent show one form of a string straightener device that can be used on bowed strings in a tennis racket that has been in use and 4,733,866 to Herbert and 4,776,591 to Ho show other forms of such a means.

The U.S. Pat. Nos. to Johnson 2,156,092, to Garver 4,082,272 and Bachnan 4,359.213 all show means used during the initial stringing operation for producing the original woven pattern in the head of a racket.

With respect to the two groups of patents mentioned above, the patents used during the initial stringing of a racket are of interest in connection with this invention, only in the broadest sense of the stringing art in showing how strings may be confined initially to a parallel or other position. There is no suggestion in either of these disclosures for using the means shown therein for straightening the strings in a racket head that has been used.

The first listed group of patents includes two patents, Newberger et al and Kent that both show rather unwieldy plate means having fixed teeth with a pyramidal shape adapted to move strings back into their original positions when pressed into the openings in the woven Pattern. These types of devices may be adequate, assuming that the spaces between the strings and the fixed teeth and their shapes are all of a standard pattern, but many of the tennis rackets in use today are strung with different woven patterns using differently spaced strings and there seems to be no standard sized shapes or sizes of spacings between the main and cross strings in many of the modern rackets.

The German patent like Newburger and Kent is adapted for use on rackets having a standard spacing between its strings. This patent depicts a device having fixed teeth, spaced apart to engage the strings of a racket to move them back into position when they have been displaced during play.

Herbert and Ho show string straightening means for use on different tennis rackets that may have strings spaced apart in different patterns. In each of these respective patents adjustably mounted string engaging pegs or teeth means are described, that must be adjusted to fit the particular string arrangement of each racket upon which the respective devices are to be used. After the pegs or teeth have been individually moved to a proper setting, they are locked in place for cooperating with the strings. This procedure requires a great deal of patience and especially when the device must be adjusted several times as the string staightener is moved across the entire face of the racket, as may be necessary when straightening the strings across the entire face of a racket, many of which have heads with shapes such that one setting of the pegs or teeth in either of their respective racks will not fit all the strung areas within the frame that must be attended to.

Another of the patents listed above is the patent to Van Schenk who shows an upholstering tool that has a series of fixed teeth for engaging and then stretching webbing in a chair structure or the like which would appear to have little relevance to the subject matter of this invention.

It is the purpose of this invention to provide a means for easily and quite accurately moving the individual bowed strings back to each of their assigned positions to which they were originally set when strung in the head, in order to maintain the proper string interaction that is produced by pulling the designed tension in each string during the original stringing operation.

It is another purpose of this invention to provide a string straightener device that can be automatically fitted to any particular pattern of woven strings as the device is being placed in position on the surface of the string pattern.

It is another purpose of this invention to make a device available that can be temporarily and easily placed on the strings in the frame adjacent a bowed string whatever the string pattern and then be manually operated to quickly return the bowed string to its original setting in the woven pattern.

It is yet another purpose of this invention to provide a device that coacts with the individual strings in various woven patterns to assuredly guide a bowed string back to its original setting in its respective pattern to preserve the original tension of the string in that woven pattern whereby to maintain the designed feel in the racket when striking a ball.

It is another purpose of this invention to make a device available that is easily portable and that can be quickly attached to the racket adjacent a bowed string and manually operated to return the string to its correct setting in order to preserve the proper tension in that string.

Other objects of the invention will appear more fully from the description below.

BRIEF DESCRIPTION OF THIS INVENTION

The device disclosed herein includes a rigid body element that is adapted to be placed on the strings in the head of a tennis racket adjacent a bowed string and that can then be operated to return the string to its designed Position in the woven pattern. The straightener takes the form of a comb-like device that extends from adjacent one end of the length of the bowed string that is to be straightened the tool and has integral teeth that are fitted between at least a plurality of the strings forming the woven pattern. The body of the device supports a plurality of flexible arms having integral teeth, which arms extend from the body across the spaces between the strings, with the teeth in engagement with one side of the string to be straightened. In its preferred form the straightener preferably has a hook element that can be positioned to engage that string just inside the frame of the racket which hook fits into that space between the strings on the other side of the bowed string from the side engaged by the teeth, the hook being positioned near the junction of that particular bowed string with the frame. When the hook is so positioned at this junction, the hook serves as a pivot about which the straightener may be turned to ensure the return of the string being moved to its exact straight line whereby to maintain the desired original designed tension in the string.

When it is to be used, the body of the straightener is placed in a flat-wise position on one side of the pattern of strings in the racket, with the integral teeth at the ends of the arms of the comb-like means extending through the spaces between the strings, then the rigid body of the device can be manually manipulated to push the bowed string back into its original position. As above mentioned ,in one form of the device the extending hook means can be used as a centering means against which to pry and the straightener is provided with a pointer at its other end to help, indicate when the string has been moved back to about its original setting to make certain that the string is properly set in a straight line position, whereby to re-establish the original tension in the formerly bowed string.

DRAWINGS

DETAILED DESCRIPTION

Figure 1:
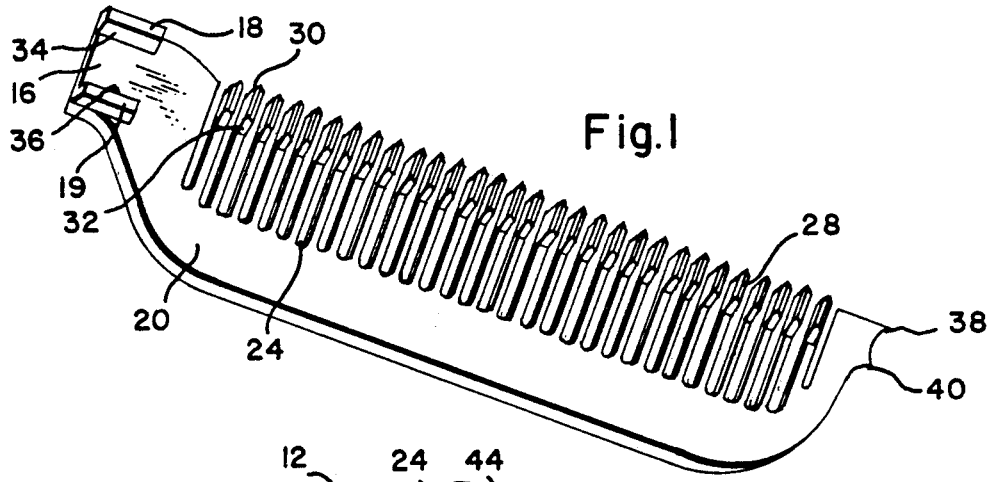
FIG. 1 is a perspective view of the staightener device looking at its bottom side.
Figure 2:
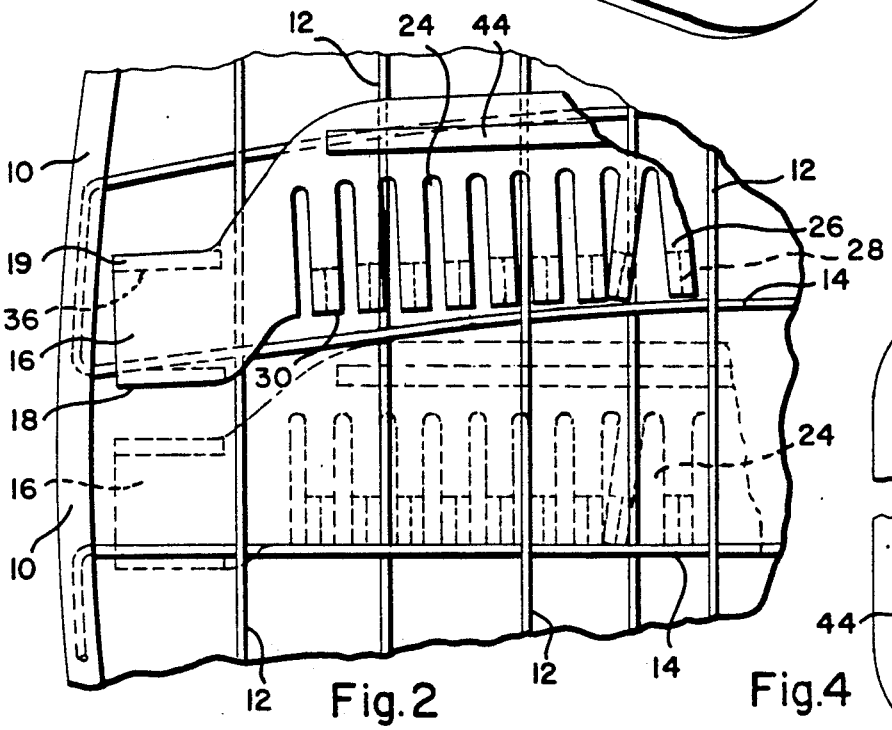
FIG. 2 is an enlarged top view partly broken away showing the straightener in full lines mounted adjacent a bowed string in the head of a racket, next to a string to be straightened, and in dotted lines next to a string that has been straightened.

A tennis racket partly broken away is shown in FIG. 2 having a head element 10 supported in a conventional manner through a throat portion from a handle, not shown. The frame has a plurality of holes extending generally at right angles through the wall that forms the head through which the main strings 12 and the cross strings 14 are threaded. In a conventional racket the strings 12 and 14 are woven into a simple crossing pattern with the strings disposed at right angles to each other, however. the strings are not always equally spaced apart and the size of the spaces between the string are not always uniform. Frequently the strings in the center area of the head, the so called "sweet spot", are spaced more closely together. In some of the more exotic rackets the patterns of stringing makes use of strings disposed at an angle of other than a right angle one with respect to the other yet it will be seen as this description proceeds that this device may be used equally well in any such pattern on the strings even in a non-conventional unevenly spaced stringing pattern.

No matter the pattern, the strings are woven into the desired arrangement and as the stringing proceeds the strings are ultimately tightened to produce the desired tension in the strings to give the racket the feel the particular player desires. Some strings are pulled to produce a tension of 70 pounds or more on the strings and some rackets are strung with a much less tension, as little as with a 40 pound tension. Each racket, depending upon the stiffness of its frame and the tension of its strings , has a characteristic feel as the tennis ball is struck, and the more experienced players can easily detect when the proper tension is present in the strings in the particular racket being used. It is of course desirable to maintain a consistent feel at all times when putting the ball in play and if the strings become displaced from their original positions in the stringing pattern it is obvious that when the string becomes elongated as it is stretched to occupy a bowed position, the original tension produced during the stringing process is altered . Normally when one string is stretched into another position, other strings more or less parallel to it are likewise moved into a generally parallel distorted pattern from their original positions and the cumulative effect of the displacement of several of the strings from their original positions in the pattern, can cause an experienced player to feel a discernible change in the hitting properties of the racket.

It is therefore essential to provide a means for maintaining the strings in their proper parallel positions in the woven pattern without in any way interfering with their normal mode of interacting one with the other in so far as possible, and the device shown herein can be used for this purpose.

As best seen in the full and dotted line positions of FIG. 2, the preferred form of the string straightener of this invention includes an end 16 that has hook elements 18 and 19 integral therewith one of which 18 is shown fitted into a space between two of the cross strings 14. The rigid main body 20 of the device is designed to have a planar bottom surface 22 shown in FIG. 3, that is placed flat-wise on one side of the string pattern and in use is designed to slide across the surface of the woven string pattern. The main body portion 20 of the device is an elongated plastic means that can be molded with a polyvinyl chloride or other suitable resin in an injection molding machine.

Figure 3:
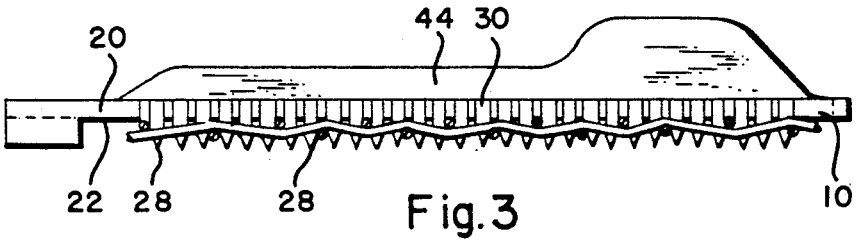
FIG. 3 is a side elevation of the straightener device showing the device mounted on the strings in the frame.

The body 20 is made with a series of parallel slots 24 that are about 1/16" wide, which slots separate the elongated arms 26 one from another. Each of the arms is about 3/32" wide and has an integral tooth 28 that depends below the planar surface 22 a distance to extend through the spaces between the strings in the woven pattern as shown in FIG. 3. Each tooth has a front wall 30 and a rear wall 32 and the bottom side of each tooth is sharpened to a V shaped edge. The centerline of the bottom of the V is made to be generally parallel with the longitudinal centerline of its respective arm 26 and when the body 20 is pressed flat-wise onto the strings to seat the planar surface 22 on the strings, the V shaped bottom edges of the teeth that may come in contact with a main string, as will appear more fully below, will cause the free end of the arms to which that tooth is affixed to flex side-wise as illustrated in FIG. 2, to permit all of the teeth on all of the arms to extend into and through the spaces between the strings.

As best seen in the solid lines of FIG. 2, the front walls 30 of all the teeth lie on the same plane, which plane is approximately perpendicular to the, plane of the bottom surface 22 of the body 20. The plane of these front walls of the teeth, if extended to the end of the straightener, would be spaced about the thickness of a racket string from the inside surface of wall 34 of the hook 18. Similarly, the rear walls 32 of the teeth 28 all lie in a common plane that if extended would be spaced about the thickness of a string from the inside wall 36 of hook 19.

Assuming that the racket is held in a horizontal position and referring to FIG. 2, the straightener device may be mounted on the racket by placing the device on the surface of the strings and adjusting it so that the end 16 of the body is adjacent one side of the head 10 with the hook 18 on one side of the bowed string to be straightened with the surface 30 of all of the arms 26 on the other side of that string. The body 20 is pressed flat against the woven pattern of the strings and the teeth 28 at the ends of the arms 26 can all be pressed into the spaces between the string to be straightened and the next adjacent string. The teeth all extend downwardly from the bottom plane 22 of the body with their faces 30 behind the bowed string and when the body is pressed flat against the woven pattern if any tooth should be pressed down on a main string 12 as shown in FIG. 2, the V shaped lower end of that tooth will spring that tooth side-wise. The front walls 30 of the teeth elements 28 will then be disposed in a substantially vertical plane to one side of the bowed cross string 14 and when the body element 20 is manually pushed over the strings, these front walls of all of the teeth successively become engaged behind the bowed string to push it toward its original position in the woven pattern.

When the string being pushed in this manner approaches its original setting in the pattern, the front sides 30 of all the teeth will approach a straight line position that extends from the hook at the junction of that string with the frame at the one end toward the junction of that string with the opposite side of the frame. When the cross string 14 has reached its original position in its pattern, the gauge 38 integral with the body 20 that is in line with the plane of the front sides 30 of all the teeth, will point to the junction of that string with the opposite side of the frame. When the gauge 38 indicates that the string has been moved to its straight line position all of the front walls 30 of the teeth will be bearing against the string to have moved it to its final position as shown in the dotted line position in FIG. 2.

The walls 32 on the rear of the teeth that cooperate with the wall 36 on the inside of hook 19 when seated against a bowed string can similarly be used against that string to move the gauge 40 into alignment with the junction of that string with the frame at its opposite end.

The preferred size of the teeth 28 has been described above, but the dimensions are not critical. The width of the teeth however must be designed to be of a size together with the size of slots 24 to permit a tooth to be moved side-wise and be pushed down through the space next to another tooth, between the main strings 12 for example as shown in FIG. 2 to produce the best results by placing the maximum number of either the front walls 30 or back walls 32 in contact with the string to be straightened when the body is pushed or pulled to rotate the straightener about either the pivot point on wall 34 or wall 36.

Figure 4:
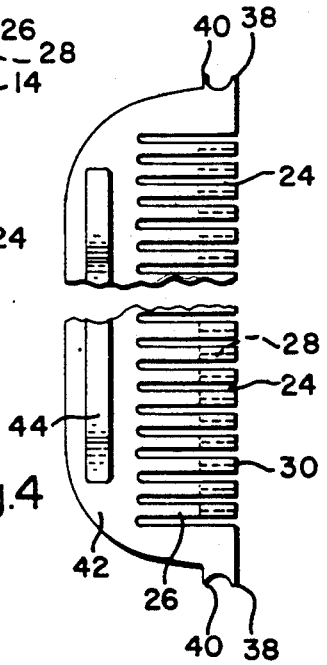
FIG. 4 is a top plan view of an alternate form of the device.

In another form of the device as shown in FIG. 4, both ends of the straightener may be fitted with gauges 38 and 40. In this form of the device the hook elements are eliminated. This device may be positioned at any point on the surface of the pattern of strings next to a bowed string and the body 42 can be pushed or pulled to adjust the position of the bowed string. In this form of the device, the pair of gauge means 38 in line with the front walls 30 of the teeth and the pair of gauges 40 in line with the rear walls 32 can be used at the opposite ends of the body 42 to assure a proper string alignment.

The straightener is preferably made of a suitable plastic that can be injection molded. A tough somewhat flexible plastic such as a polyvinyl chloride should give the proper side-wise flexibility to the arms 26 to permit the V shaped ends of teeth 28 to shift any interfering tooth side-wise as explained above.

The body 20 or the body 42 of the alternate form can preferably be made of a convenient length to extend across more than half the distance across the widest portion of the frame of the racket. It is to be noted that since the two front and back walls 30 and 32 of the teeth are made to be identical in function, that after the device has been used to straighten the substantial portion of the length of a given bowed string, the device can be reversed end to end to work against the remaining length of that string that is being straightened, if this is necessary. In use, it is principally the strings in the sweet spot in the center of the rackets head that are mainly displaced and therefore, either the body 20 or body 42 is preferably designed to have a length of more than one half the width of the widest portion of the head. However, even with a body that is shorter than one half the length of a string to be straightened, the entire length of the longest string in a racket can be easily straightened with a straightener used as above described. Normally the use of the device along the major length of the most of the strings in successive steps will be sufficient to produce the necessary straightening needed.

If desired a stiffening rib 44 as shown in FIGS. 3 and 4 can be molded onto the upper side of the body 20 or body 42. The rib will also provide a convenient handle for manipulating the respective bodies of either one of these disclosed string straighteners in applying the device to and pushing it over the surface of the woven string pattern.

While the above describes the preferred form of this invention it is possible that modifications thereof may occur to those skilled in the art that will fall within the scope of the following claims.

I claim:

1. A straightener that is self adjustable to fit onto and coact with the strings in the head of a tennis racket, said head having any one of a variety of the different woven patterns having different spacings between the strings forming the spaced apart main and cross strings in a tennis racket, the woven patterns each having a thickness defined by a generally planar front side surface and a generally planar back side surface, said straightener comprising a substantially rigid body having a planar bottom surface that has a sliding contact on the plane of one of said front or back surfaces of the woven pattern of the strings, said body supporting a plurality of flexible arms that extend outwardly in the same direction from said body, each one of said arms having a free end that coincides with said plane of the planar bottom surface of said body, said arms being disposed in a substantially parallel relation one with respect to the other, each one of said arms having a tooth integral with its free end, said teeth all extending in the same direction and at generally a right angle with respect to said planar bottom surface of said body, the shape of each tooth and the dimensions of said shape being such that two or more of said teeth may fit simultaneously into and extend through one of said spacings into which one or more of said teeth may be pressed when said planar bottom surface of said body is pressed against said one surface of said woven pattern, each one of said teeth having at least one exposed surface for engaging with a string when fitted into its respective space, all of said string engaging surfaces of said teeth being positioned along a straight line to be in alignment one with respect to the other before said arms are pressed against said one surface, and said body having a length to extend across a plurality of said spaces between the strings in said pattern.

2. A straightener as in claim 1 wherein said arms are integral with said body.

3. A straightener as in claim 1 wherein said arms all have planar bottom surfaces that are coextensive with said bottom planar surface of said body.

4. A straightener as in claim 1 wherein at least one of the teeth integral with said flexible arms is caused to be moved side-wise when said body is pressed against said one surface of the string pattern of said racket and more than one of said teeth is pressed to fit into at least one of said spacings.

5. A straightener as in claim 1 wherein the ends of said teeth that are the opposite ends from their integral ends are each configured to have a cam surface that may engage against the side of a string in said pattern as the respective teeth are pressed downwardly into the spaces in said woven pattern in order to cause any one of the respective arms having a tooth with an engaged cam surface to move sidewise and permit that engaged tooth or teeth to enter into and pass through one of said spaces as the body is being pressed against said one surface of said woven pattern.

6. A straightener as in claim 1 wherein said strings in the racket all have the same diameter and said body includes an extending end portion that supports a hook means, said hook means having a string engaging bearing surface, said bearing surface being spaced from a projection of said straight line a distance equal to the thickness of said string.

7. A straightener as in claim 6 wherein said body has a length to extend about half way across the width of said woven pattern in the head.

8. A string straightener for use against the bowed strings in a tennis racket head, said head having a pattern of main and cross strings with spaces between the main and cross strings, said straightener comprising a rigid elongated body having a substantially planar bottom surface adapted to be pressed against said pattern of strings, a plurality of flexible arms supported from said body in a parallel arrangement, said arms each having a free end, each one of said arms having a tooth integral with said free end, each of said teeth having a front wall and a bottom wall, all of the front walls of said teeth being disposed at a right angle to said planar bottom of said straightener and falling along a straight line, each one of said bottom walls of said teeth being configured to move its respective tooth side-wise together with its respective flexible arm when said body together with said arms are pressed against said pattern of strings adjacent a bowed string to be straightened and said bottom wall of any one of said teeth moving into one of said spaces engages against a string, said teeth having a size to permit more than one tooth to be pressed into any one of the spaces between said strings when said planar bottom of said body and said arms are pressed against said string pattern whereby to position said front walls of said teeth adjacent said bowed string in said head so that when said straightener is pushed across said pattern of strings and said front walls become engaged against the bowed string said walls cause the bowed string to be straightened.

9. A straightener as in claim 8 wherein each tooth has a rear wall that is disposed at a right angle to said planar surface of the body, and all of said rear walls lie along a straight line whereby said body may be pushed or pulled against a bowed string.

10. A straightener as in claim 8 wherein said body has an extended end for supporting hook means, said hook means having a bearing surface for engaging against the side of the bowed string that is to be straightened, said bearing surface being spaced from an extension of said straight line a distance about equal to the thickness of the string to be straightened.

11. A straightener as in claim 8 wherein said body includes indicating means to show when the string has been moved to a straight line position.

12. A straightener as in claim 1 wherein said body includes indicating means to show when the string has been moved to a straight line position.

* * * * *